United States Patent [19]

Hartley

[11] 4,183,649

[45] Jan. 15, 1980

[54] OIL DERRICK STRING-UP APPARATUS AND METHODS

[76] Inventor: Charlie Hartley, Box 95, Durham, Okla. 73642

[21] Appl. No.: 901,219

[22] Filed: Apr. 28, 1978

[51] Int. Cl.[2] ..... B66C 23/60

[52] U.S. Cl. ..... 254/139.1; 254/166; 242/86.5 R

[58] Field of Search ..... 254/139.1, 139, 145, 254/135 R, 166, 183, 184, 185 R, 188, 190 R, 134.3 R, 134.3 FT; 242/54 R, 85, 86.5, 86.3, 86.6; 180/14 C, 74; 24/1, 73 R

[56] References Cited

U.S. PATENT DOCUMENTS

| | | | |
|---|---|---|---|
| 1,348,448 | 8/1920 | Robison | 242/54 R |
| 2,067,942 | 1/1937 | Nichols | 254/188 |
| 3,033,528 | 5/1962 | Wilson | 254/166 |
| 3,075,599 | 1/1963 | Yadon et al. | 180/14 C |
| 3,121,557 | 2/1964 | Turner | 254/134.3 R |
| 3,271,009 | 9/1966 | Wright et al. | 254/134.3 R |
| 3,625,445 | 12/1971 | Hall | 242/54 R |
| 4,083,531 | 4/1978 | Merz | 254/134.3 R |

*Primary Examiner*—Kenneth W. Noland
*Attorney, Agent, or Firm*—Laney, Dougherty, Hessin & Beavers

[57] ABSTRACT

An apparatus is provided for removing and replacing heavy steel drilling cable within the derrick structure of an oil drilling rig. The apparatus includes a first powdered winch for carrying a guide cable, said first winch including apparatus for selectively engaging and disengaging a first winch spool from a first winch shaft. A disc brake is provided for applying a retarding force to said first winch spool to brake its rotational motion. The apparatus also includes a second powered winch for receiving a length of guide rope, said second powered winch including a plurality of friction drive collars. The apparatus is mounted upon a vehicle for moving the friction drive collars into engagement with flanges of a drilling cable storage spool so that the spool may be rotated by the driving force of the collars thereby pulling the drilling cable onto the storage spool. Methods are disclosed for use of this apparatus in removing and replacing the drilling cable within the oil rig.

39 Claims, 15 Drawing Figures

OIL DERRICK STRING-UP APPARATUS AND METHODS

BACKGROUND OF THE INVENTION

1. Field of the Invention

This invention relates generally to apparatus and methods for removing and replacing a flexible line within a sheave system, and more particularly, but not by way of limitation, to apparatus and methods for removing and replacing a heavy steel drilling cable within a derrick structure of a drilling rig.

2. Description of the Prior Art (Prior Art Statement)

The following statement is intended to be a prior art statement in compliance with the guidance and requirements of 37 CFR SS1.56, 1.97 and 1.98 and with S609 of the Manual of Patent Examining Procedure.

Although the prior art shows several devices for stringing-up power lines upon telephone poles and the like, very little has been done in the way of automating the stringing-up and removal of drilling cables from oil derrick structures. One very early, somewhat related, device is that of Robison shown in U.S. Pat. No. 1,348,448. Robison merely shows those components of an oil drilling rig which are associated with the drilling cable. No apparatus is shown for use with those components to assist in the stringing-up and removal of the drilling cable from the drilling rig. The components of a typical drilling rig similar to those shown in Robison are described in detail with reference to the present invention in this specification under the sub-title "The Drilling Derrick". Also, a portable type drilling rig of more modern construction is shown in U.S. Pat. No. 3,033,528 to Wilson.

U.S. Pat. No. 3,625,445 to Hall shows a device somewhat similar to the friction drive collars of the present invention.

The following U.S. Patents are of interest in that they show various prior art devices for the stringing of transmission wires upon telephone poles and the like. It will be apparent, however, that their relevance to the present invention is slight in that none of them show an apparatus which could be used for the stringing-up and taking down of drilling cables from an oil derrick. These U.S. patents are No. 3,520,489 to Flowers; No. 3,091,413 to Leithiser; and No. 3,073,574 to Garnett.

Also of interest are the prior art methods which have been used for removing and replacing drilling cables within a drilling rig. These prior art methods have been rather unsophisticated brute force methods involving mainly the manual placement of the lines within a sheave system and involving methods of removal which again require a great deal of manual labor. These prior art methods are described in detail in this specification under the sub-title "Standard Rig Methods". It is apparent from those methods there described, which methods are currently in use throughout the drilling industry, that the prior art is void of any apparatus or methods having any substantial similarity to those of the present invention.

SUMMARY OF THE INVENTION

An apparatus is provided for removing and replacing heavy steel drilling cable within the derrick structure of an oil drilling rig. The apparatus includes a first powered winch means for carrying a guide cable, said first winch means including means for selectively engaging and disengaging a first winch spool from a first winch shaft. Disc brake means is provided for applying a retarding force to said first winch spool to brake its rotational motion. The apparatus also includes a second powered winch means for receiving a length of guide rope, said second powered winch means including a plurality of friction drive collars. The apparatus is mounted upon a vehicle which provides a means for moving the friction drive collars into engagement with flanges of a drilling cable storage spool so that the spool may be rotated by the driving force of the collars thereby pulling the drilling cable onto the storage spool. Methods are disclosed for use of this apparatus in removing and replacing the drilling cable within the oil rig.

It is therefore a general object of the present invention to provide apparatus and methods for the removal of a flexible line from a sheave system.

A further object of the present invention is to provide apparatus and methods for the stringing-up or placement of a flexible line within a sheave system.

Another object of the present invention is to provide apparatus and methods for the removal of a heavy steel drilling cable from a drilling rig derrick structure.

And another object of the present invention is the provision of apparatus and methods for the stringing-up of a heavy steel drilling cable within an oil derrick drilling structure.

Yet another object of the present invention is the provision of an apparatus including friction drive collars for engagement with a rotatable drilling cable storage spool to provide a means for rotating said storage spool to reel the drilling cable upon the same.

And another object of the present invention is the provision of improved methods for the stringing-up of a guide cable within a derrick structure by the use of a guide rope attached to said guide cable, so that said guide cable may be placed within the derrick structure in an improved highly efficient manner, and the guide cable may then be attached to a drilling cable so that the drilling cable may be pulled into place within the derrick structure.

Yet another object of the present invention is to provide methods for stringing-up and taking down drilling cables within a standard drilling rig.

And a further object of the present invention is to provide methods and apparatus for the stringing-up and taking down of drilling cables from a jackknife rig.

Other and further objects, features and advantages of the present invention will be readily apparent to those skilled in the art, upon a reading of the description of the preferred embodiments which follows, when taken in conjunction with the accompanying drawings.

DETAILED DESCRIPTION OF THE PREFERRED EMBODIMENTS OF THE INVENTION

The String-Up Machine

Throughout this specification, various flexible lines will be referred to by designations such as line, rope or cable. These designations are used for the purpose of clarity so as to have different sounding names on as many of the elements as possible within the specification to avoid confusion. It is to be understood, however, that any designation such as cable, rope or line is not to be restricted to any specific type of flexible member but rather includes any type of flexible member whether it be of monofilament or woven-type construction and whether it be constructed of metallic, natural fiber, synthetic fiber or any other material.

Figure 1:
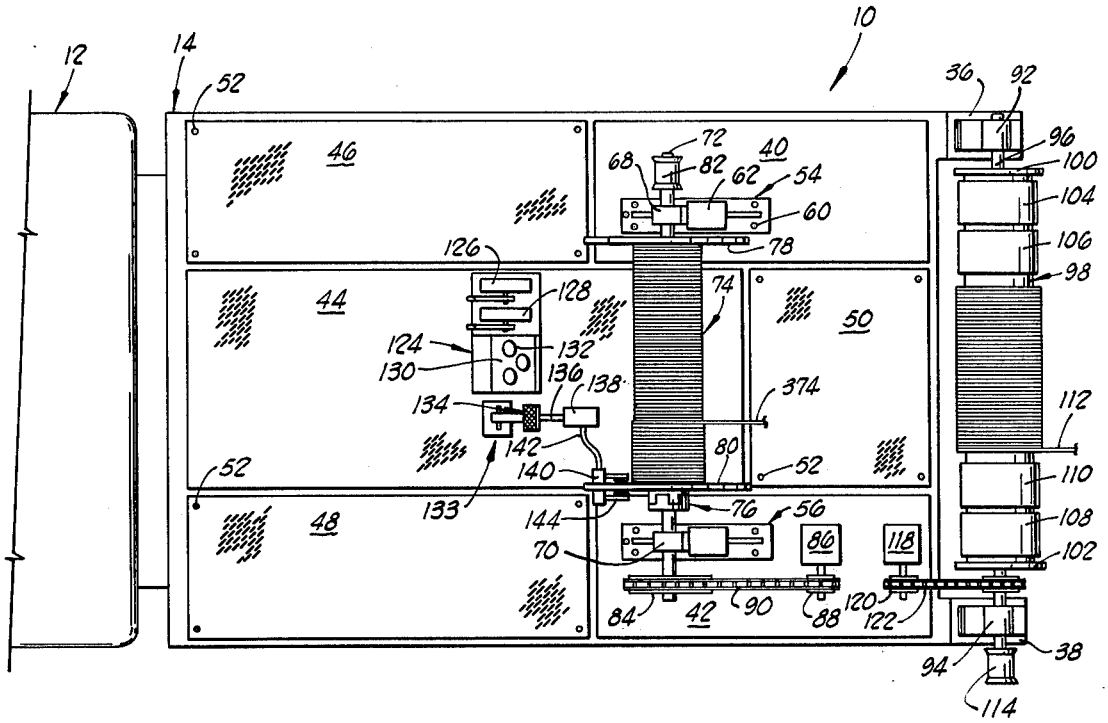
FIG. 1 is a plan view of the string-up machine of the present invention.
Figure 2:
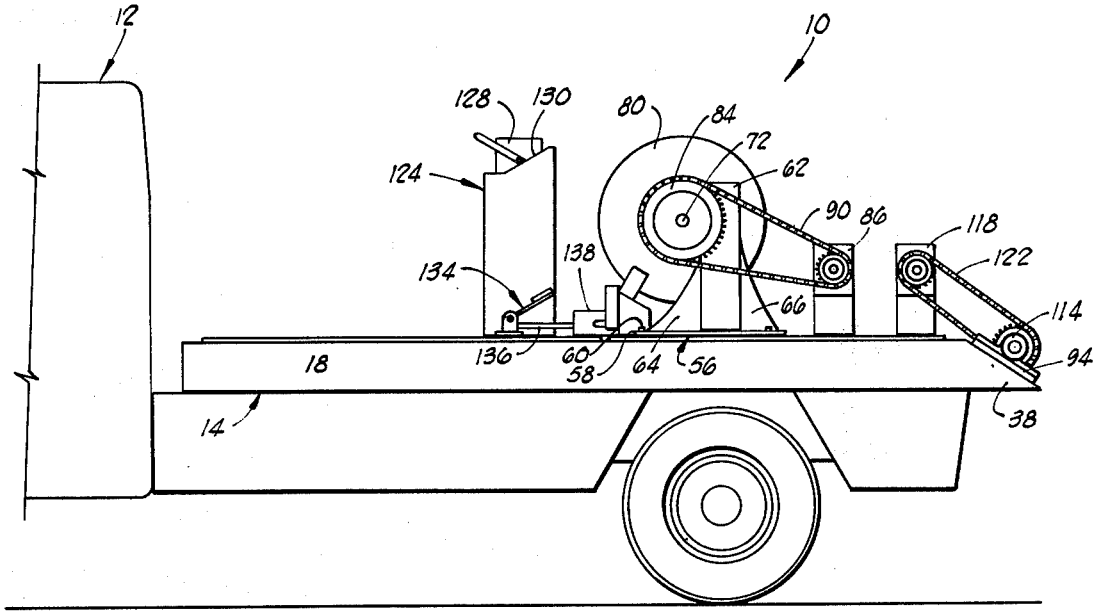
FIG. 2 is a side elevation view of the apparatus of FIG. 1.

Referring now to the drawings and particularly to FIGS. 1 and 2, the string-up machine of the present invention is shown and generally designated by the numeral 10. The string-up machine 10 is shown mounted upon a truck or vehicle 12. The string-up machine includes a frame, generally designated by the numeral 14, which is attached to the truck 12.

Figure 3:
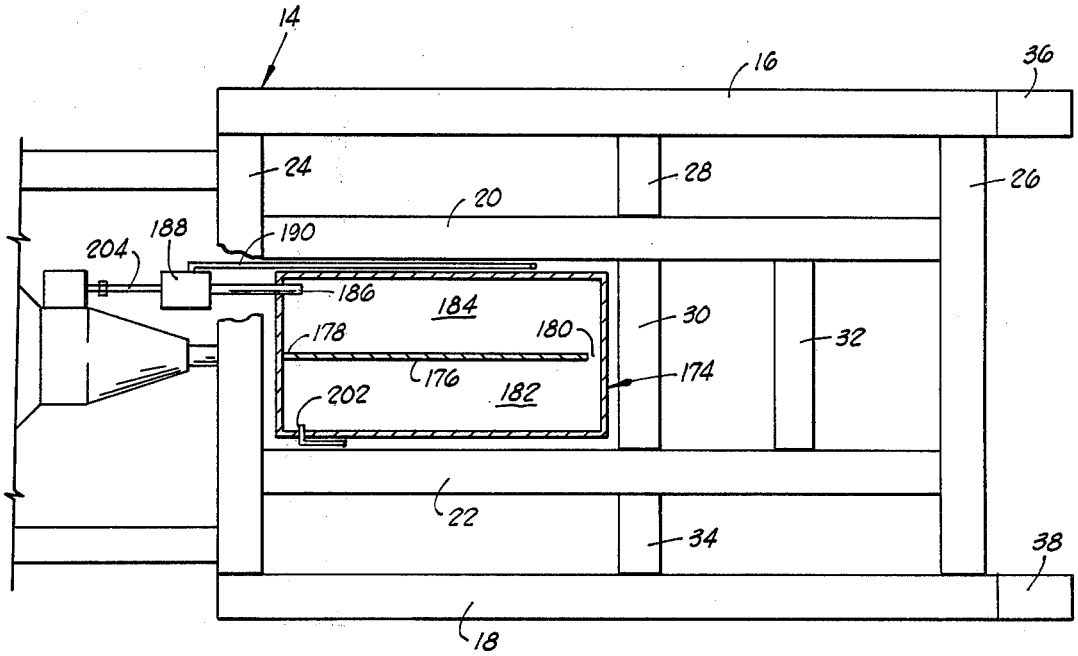
FIG. 3 is a plan view of the frame of the apparatus of FIG. 1.

Referring to FIG. 3, a plan view of the frame 14 is shown, with those components of the string-up machine 10 located above the frame having been removed. The frame 14 includes a pair of outside longitudinal members 16 and 18 and a pair of inside longitudinal frame members 20 and 22.

The longitudinal frame members are connected at their ends by the front transverse frame member 24 and the rear transverse frame member 26. The longitudinal frame members 16 and 20 are connected by a first intermediate transverse frame member 28. The inside longitudinal frame members 20 and 22 are connected by second and third intermediate transverse frame members 30 and 32. The longitudinal frame members 22 and 18 are connected by a fourth intermediate transverse frame member 34.

The outside longitudinal frame members 16 and 18 include sloped rearward extensions, 36 and 38, respectively.

Referring to FIGS. 1 and 3, the space between the frame members 16, 28, and 20 and 26 is spanned by a first support plate 40. The space between frame members 22, 34, 18 and 26 is spanned by second support plate 42. The first and second support plates 40 and 42 are preferably comprised of one-half inch thick steel plate welded to the frame 14.

The area between frame members 20, 24, 22 and 32 is spanned by a first cover plate 44. The first cover plate 44 is preferably comprised of one-quarter inch steel plate having a tread type surface pattern to provide a non-slip surface upon which a workman may stand.

The area between frame members 16, 24, 20 and 28 is spanned by a second cover plate 46. The area between frame members 22, 24, 18 and 34 is spanned by a third cover plate 48. The area between frame members 20, 32, 22 and 26 is spanned by fourth cover plate 50.

The second, third and fourth cover plates 46, 48 and 50 are preferably constructed of a non-slip surfaced steel plate like that of the first cover plate 44. Additionally, cover plates 46, 48 and 50 are removable cover plates which are held in place by a plurality of hold down means 52 which may be bolts or other suitable metal fasteners. Beneath each of the removable cover plates 46, 48 and 50 there is a storage compartment which is constructed by welding a steel plate across the bottom of those portions of the frame 14.

Attached to the support plates 40 and 42 are winch support brackets 54 and 56, respectively. Each of the winch support brackets 54 and 56 includes a mounting plate 58 attached to its respective support plate by a plurality of bolts 60. Extending vertically upward from the mounting plate 58 is a support column 62 which is reinforced by gusset plates 64 and 66 fixedly attached between the front and rear sides of the support column 62 and the mounting plate 58. Mounted upon the front side of the vertical support columns 62, of the winch support brackets 54 and 56, are pillow blocks 68 and 70, respectively, each of which rotatingly receives an end of a first winch shaft 72. Rotatingly mounted upon the winch shaft 72, between the winch support brackets 54 and 56, is a first winch spool 74. Attached to an end of the winch spool 74, adjacent the support bracket 56, is a dog 76 which provides a means by which the winch spool 74 may be selectively connected with or disconnected from the winch shaft 72 so as to allow spool 74 to be driven by the shaft 72 or to allow the spool 74 to freely spin about the shaft 72.

The winch spool 74 includes first and second radially extending end flanges 78 and 80.

Attached to the first winch shaft 72, outside of the pillow block 68, is a first cathead 82 which is fixedly attached to the shaft 72 to rotate therewith, by a set screw or other suitable means.

Attached to the other end of the shaft 72 outside of the pillow block 70 is a first winch shaft gear 84 which is fixedly attached to the shaft 72 to rotate therewith.

Rearward of winch support bracket 56 there is mounted upon the support plate 42 a first hydraulic motor 86 having a first drive gear 88 attached thereto. The hydraulic motor 86 provides a power drive means for rotating the first winch shaft 72. A first drive chain 90, which may also be referred to as a power transmission means, engages the drive gear 88 and the winch spool gear 84 so that the first winch shaft 72 may be driven by the first hydraulic motor 86.

Mounted upon the sloped rearward extensions 36 and 38, of the outside longitudinal frame members 16 and 18, are pillow blocks 92 and 94, respectively. Each of the pillow blocks 92 and 94 rotatingly receives an end of a second winch shaft 96. Fixedly attached to the winch shaft 96, so as to rotate therewith, is a second winch spool 98, which has radially extending flanges 100 and 102 at each end thereof, inside of the pillow blocks 92 and 94, respectively.

Inside of and adjacent the flange 100, a pair of transversely spaced friction drive collars 104 and 106 are concentrically and fixedly attached to the external surface of the second winch spool 98.

Inside of and adjacent the flange 102, another pair of friction drive collars, 108 and 110, are concentrically and fixedly attached to the external peripheral surface of the winch spool 98. The friction drive collars preferably are constructed from resilient drill pipe bumpers that are used in wells to prevent the drill pipe from contacting the casing. Wrapped around that portion of the external surface of the winch spool 98 between the friction drive collars 106 and 110 is a length of rope or other flexible line 112.

The second winch spool 98 and the friction drive collars are mounted upon the sloped rearward extensions 36 and 38, of the frame 14, so that when the friction drive collars engage a spool, such as the drilling cable storage spool 370 of FIG. 9, below a horizontal centerline of the storage spool 370, the force exerted on the friction drive collars, by the storage spool 370, will urge the friction drive collars toward the sloped rearward extensions 36 and 38. This effectively wedges the friction drive collars under the storage spool 370, thereby assisting in the forceable frictional engagement of the drive collars with the flanges of the storage spool 370. This forceable engagement is aided by the weight of the storage spool 370.

Attached to an end of the second winch shaft 96 outside of the pillow block 94 is a second cathead 114 which is fixedly attached to the winch shaft 96 so as to rotate therewith.

Fixedly attached to the winch shaft 96 between the flange 102 and the pillow block 94 is a second winch shaft gear 116. Rearward of the first hydraulic motor 86 there is attached to support plate 42 a second hydraulic motor 118, having a second drive gear 120 attached thereto. A second drive chain 122 engages the second drive gear 120 and the second winch shaft gear 116 so that the second winch shaft 96 may be driven by the second hydraulic motor 118.

Mounted upon the first cover plate 44 is a control console 124. The control console 124 has mounted thereon first and second four-way control valves 126 and 128, for controlling first and second hydraulic motors 86 and 118, respectively. The control valves 126 and 128 are four-way control valves which permit each of the motors 86 and 118 to be driven in both directions at varying speeds.

Mounted within a sloped surface 130 of the control console 124 are a plurality of gauges 132 which provide a read out means for various operating parameters of the string-up machine 10, such as oil pressure.

To the side of the control console 124 there is located a disc brake assembly generally designated by the numeral 133. The disc brake assembly 133 includes brake pedal 134 which is pivotally attached to the cover plate 44. Brake linkage 136 connects the pedal 134 to the brake master cylinder 138. Movement of the linkage 136 creates hydraulic pressure within the master cylinder 138, which pressure is directed to disc brake caliper 140 by the hydraulic brake line 142.

The disc brake caliper 140 includes a pair of brake pads 144 which clamp about the flange 80 of the winch spool 74 to provide a braking or retarding force to the rotating motion of the winch spool 74. The flange 80 is preferably constructed of one-half inch thick steel plate and serves as the disc in the disc brake assembly.

Figure 5:
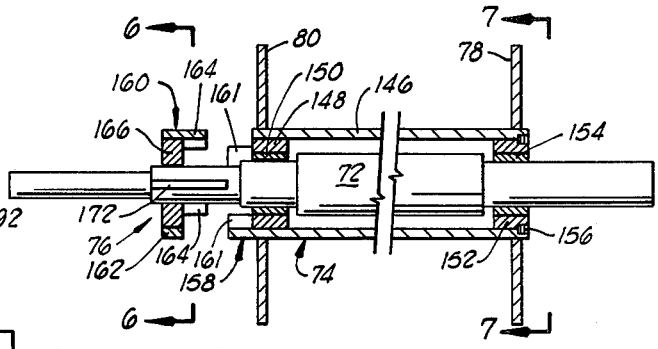
FIG. 5 is a rear elevation partially sectional view of the front winch of the apparatus of FIG. 1.
Figure 6:
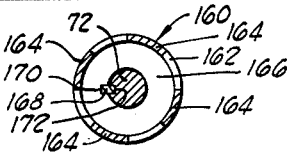
FIG. 6 is a sectional view taken along line 6—6 of FIG. 5.
Figure 7:
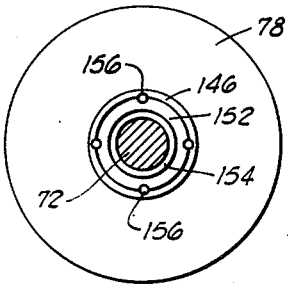
FIG. 7 is a sectional view taken along line 7—7 of FIG. 5.

Referring now to FIGS. 5, 6 and 7, the details of construction of the first winch shaft 72, the first winch spool 74 and the dog 76 are shown. FIG. 5 is a partly sectional rear elevation view of those components. The first winch spool 74 includes a cylindrical pipe section 146 to which the flanges 78 and 80 are fixedly attached. Internal to the pipe section 146 adjacent the flange 80 is a steel doughnut 148, the outer periphery of which is fixedly attached to and closely received by the internal surface of the pipe 146. Closely received within the internal diameter of the doughnut 148 is a first brass bushing 150 which is press fit within the doughnut 148. The brass bushing 150 rotatingly engages the shaft 72 and serves as a bearing surface between the spool 74 and the shaft 72.

Closely received within the internal surface of the pipe 146 adjacent the flange 78 is a second steel doughnut 152. A second brass bushing 154 is press fit within the second doughnut 152.

The second doughnut 152 is mounted flush with the end of the pipe 146. Spaced at 90° intervals around the outer periphery of the doughnut 152 there are drilled four set screw holes which span the engaging surfaces of the pipe 146 and the doughnut 152 as is best seen in FIG. 7. Threadedly received within these set screw holes are a plurality of set screws 156. The set screws 156 are preferably allen screws whose outer ends will be flush with the end surface of the pipe 146 and the doughnut 152 when the set screws 156 are fully inserted into the set screw holes.

This construction permits the winch shaft 72 to be removed from the winch spool 74 by removing the set screws 156 and then pulling the shaft 72 along with the second doughnut 152 out of the pipe section 146.

Extending from the winch spool 74 outside of and adjacent the flange 80 is the dog 76. The dog 76 includes a fixed portion 158 and a sliding portion 160. The fixed portion 158 comprises four fixed teeth 161 which are tooth-like extensions of the pipe section 146.

The sliding portion 160 of the dog 76 includes a short cylindrical pipe portion 162 which is concentric with and of equal diameter to the pipe portion 146 of the winch spool 74. The cylindrical portion 162 has axially extending therefrom four sliding teeth 164 which are complementary to and mesh with the fixed teeth 161 of the fixed dog portion 158. Fixedly attached to the internal surface of the cylindrical portion 162 is a third doughnut 166. The third doughnut 166 is slidingly received upon the shaft 72 by means of the key 168 which is received within keyways 170 and 172 of the doughnut 166 and the shaft 72, respectively.

In viewing FIG. 6, the construction of the teeth 164 of the sliding dog portion 160 is shown. The construction of the complementary fixed teeth 161 of the fixed dog portion 158 is similar. Each of the dog teeth comprises an arc of 45° about the circumference of its respective pipe portion.

The dog 76 is shown in the disengaged or disconnected position in FIG. 5. In this position, the first winch spool 74 is permitted to freely rotate about the first winch shaft 72. To fixedly attach the winch spool 74 to the shaft 72, the sliding portion 160 of the dog 76 is moved into engagement with the fixed portion 158 so that the sliding teeth 164 of the sliding portion 160 mesh with the fixed teeth 161 of the fixed portion 158 whereby the rotating driving force of the shaft 72 is transmitted to the spool 74 through the key 168 and the dog 76.

Figure 4:
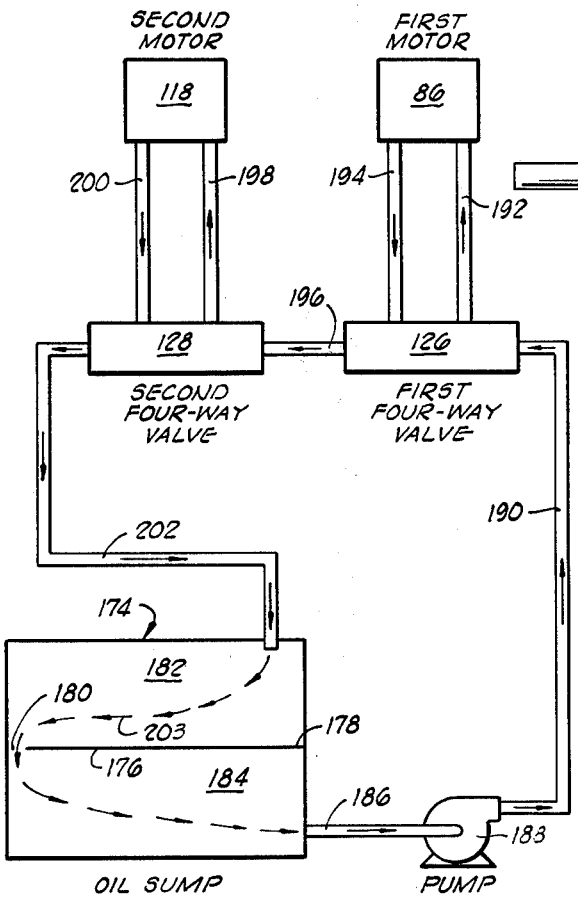
FIG. 4 is a schematic view of the hydraulic system of the string-up machine of FIG. 1.

Referring now to FIG. 4, a schematic view of the hydraulic system of the string-up machine 10 is shown.

An oil sump 174 includes a baffle 176 having a closed end 178 and an open end 180. The baffle 176 divides the oil sump 174 into first and second chambers or compartments 182 and 184 which are placed in fluid communication by the open end 180 of the baffle 176.

Communicating with the second compartment 184 adjacent the closed end 178 of the baffle 176 is a suction line 186, the other end of which is connected to the hydraulic pump 188. Exiting the pump 188 is the pump discharge line 190, the other end of which is connected to the first four-way valve 126.

The first four-way valve 126 is connected to the first hydraulic motor 86 by first hydraulic motor inlet and outlet lines 192 and 194, respectively.

An outlet from the first four-way valve 126 is connected to an inlet of the second four-way valve 128 by intermediate hydraulic line 196.

The second four-way valve 128 is connected to the second hydraulic motor 118 by second hydraulic motor inlet and outlet lines 198 and 200, respectively.

An outlet of the second four-way valve 128 is connected to the hydraulic return line 202, the other end of which communicates with the first compartment 182 of the oil sump 174 adjacent the closed end 178 of the baffle 176.

The hydraulic fluid or oil which is returned to the sump 174 by the return line 202 then must travel twice the length of the baffle 176, as is indicated by the arrows 203, to reach the hydraulic suction line 186. This retention within the oil sump 174 provides time for any air bubbles and the like created within the hydraulic fluid as it flows through the hydraulic system to be dispelled from the fluid before it once again enters the suction line 186.

Referring now to FIG. 3, certain portions of the hydraulic system of FIG. 4 are shown in a partially schematic manner. The oil sump 174 is preferably constructed integrally with the frame 14 by enclosing the upper and lower portions of the frame between the frame members 20, 24, 22 and 30.

The hydraulic pump 188 is driven from the engine of the truck 12 by means of power take off shaft 204. The power take off shaft 204 may be selectively connected to or disconnected from the power drive from the engine of the truck 12 by a conventional lock out gearing (not shown) which allows the power take off shaft 204 to be disengaged when the string-up machine 10 is not in use.

The Drilling Derrick

In order to understand the function of the string-up machine 10 and the methods later to be described for installing and removing drilling cables within an oil well derrick, it is necessary to be familiar with the manner in which a conventional oil well drilling derrick is constructed and the manner in which the drilling cable is attached to the drilling rig.

Figure 8:
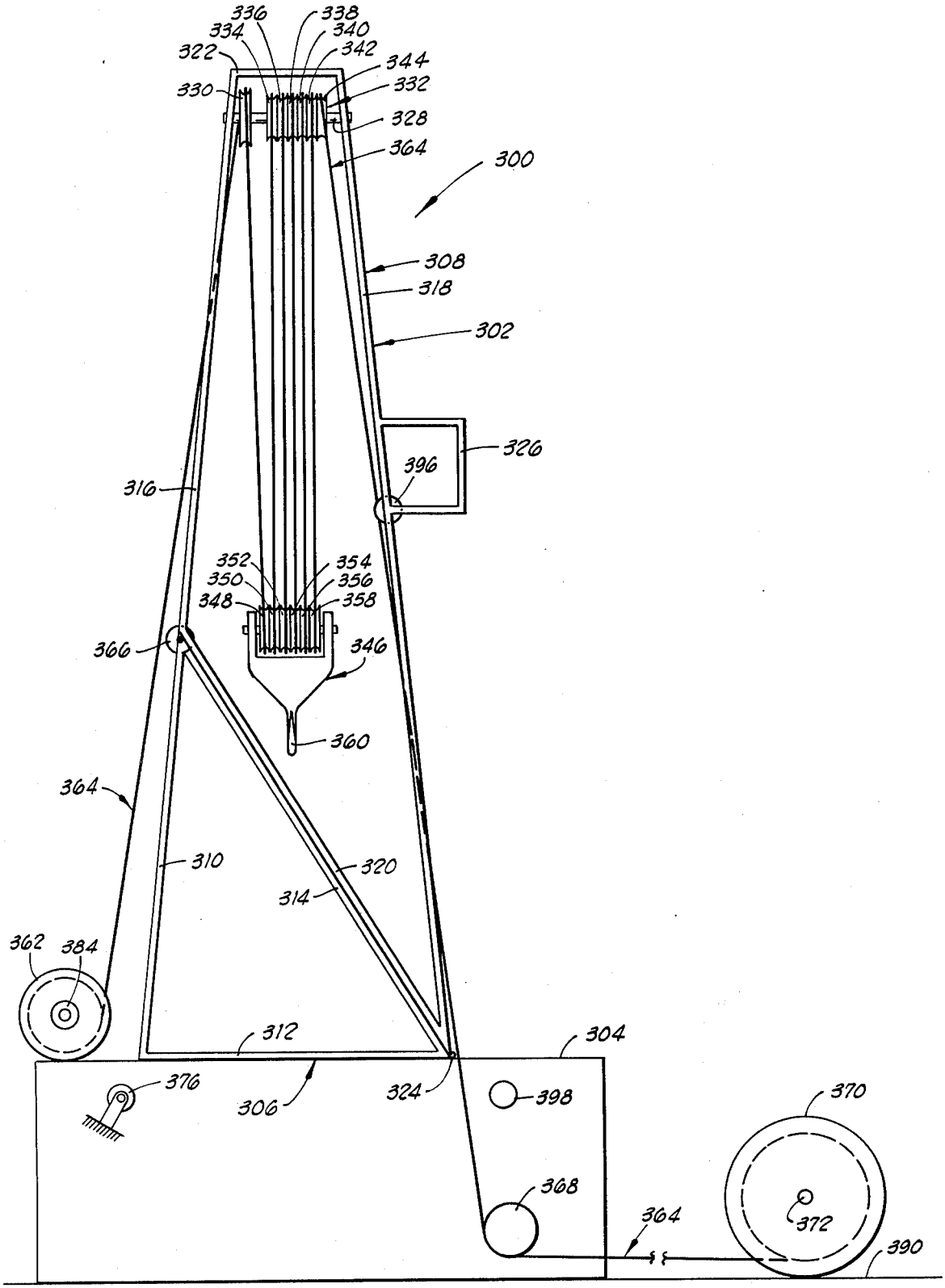
FIG. 8 is a side elevation view of a drilling rig, with a schematic representation of the derrick structure and the various sheaves and pulleys included in the structure along with the drilling cable in place within the various sheaves and pulleys.

Referring now to FIG. 8, an oil well drilling rig is shown and generally designated by the numeral 300. The drilling rig 300 includes a derrick structure 302 mounted upon a drilling platform 304.

There are two general types of drilling rigs which are in conventional use. The first type is generally referred to as a "standard" rig and the second type is generally referred to as a "jackknife" rig. The derrick shown in FIGS. 8 and 9 is a jackknife rig. In a standard rig the derrick is of integral construction and remains in an upright position at all times. In a jackknife rig, a major portion of the derrick may be pivoted about a lower support of the derrick to lay that major portion down to a horizontal position for servicing as is shown in FIG. 9. As will be described later, the methods used for installing and removing a drilling cable within the two types of rigs will vary. For the purposes of this disclosure, the methods of installing and removing a drilling line for a standard rig will be described with reference to FIG. 8.

Figure 9:
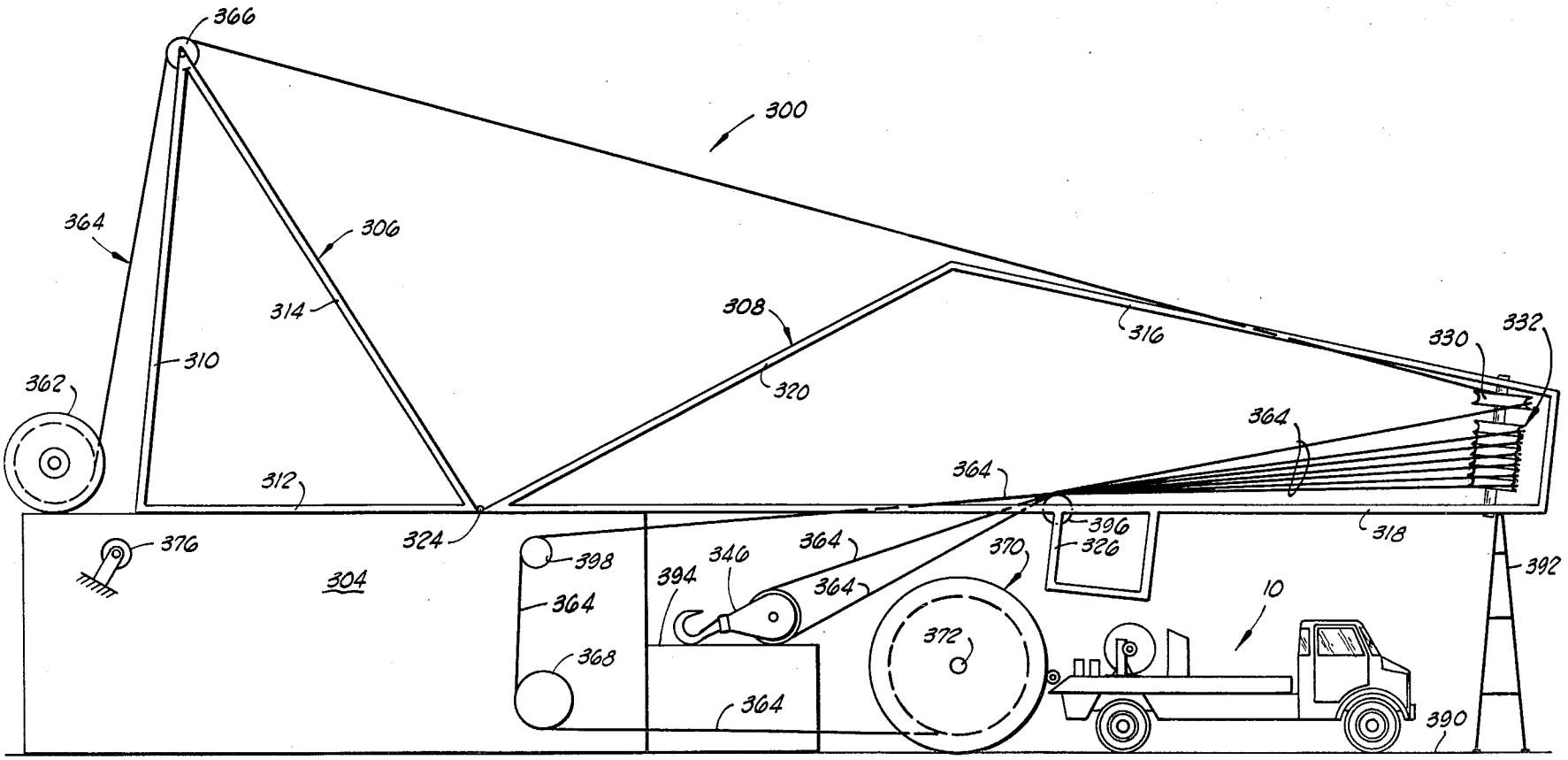
FIG. 9 shows the drilling rig of FIG. 8 with the jackknife derrick structure in its lower horizontal position.

The derrick 302 is shown in a somewhat schematic form in FIGS. 8 and 9. The derrick 302 comprises a lower fixed A-leg portion 306 and an upper pivoted portion 308.

The A-leg portion 306 includes a substantially vertical side member 310, a base member 312, and a sloping second side member 314. The members 310, 312 and 314 comprise a rigid triangular structure which is fixedly attached to the drilling platform 304.

The pivoted portion 308 includes first and second substantially vertical side members 316 and 318. The lower ends of the members 316 and 318 are connected by a sloped member 320 which is coextensive with the sloped member 314 of the A-leg structure 306 when the jackknife derrick is in the upright position as shown in FIG. 8.

The upper portions of the side members 316 and 318 are connected by horizontal member 322.

The pivoted portion 308 is pivotally connected to the A-leg 306 and the drilling platform 304 at pivot point 324.

Attached to one side of the pivoted portion 308 is an extension platform 326.

Rotatingly mounted about an axis 328 in the upper portion of the derrick 302 is a fastline sheave 330 and a crown generally designated by the numeral 332. The crown 332 includes six individually rotatable concentric sheaves 334, 336, 338, 340, 342 and 344.

Suspended from the fastline sheave 330 and the crown 332 is a block 346 which includes six individually rotatable concentric block sheaves 348, 350, 352, 354, 356 and 358. The lower portion of the block 346 includes a hook member 360 for engaging an upper end of the drill string tubing (not shown) of the drilling rig 300.

To one side of the derrick 302 there is mounted upon the drilling platform 304 a drawworks drum 362. The drawworks drum 362 is a powered rotating drum to which one end of a drilling line or drilling cable 364 is attached so that the drilling cable may be wound thereon.

The drilling cable 364 will now be traced through the drilling rig 300 starting at the connection of the drilling cable 364 to the drawworks drum 362.

From the drawworks drum 362 the drilling dable 364 extends upward to and engages the fastline sheave 330. The drilling cable 364 passes closely adjacent a roller 366, which is rotatingly attached to the upper apex of the A-leg 306. In the upright position of the jackknife derrick the roller 366 is not generally engaged by the drilling cable 364. The function of the roller 366 will become apparent upon a description of the pivoted position of the jackknife rig as seen in FIG. 9. In a standard rig the roller 366 is not present, and the drilling cable 364 typically is located inside of the substantially vertical legs 310 and 316, rather than outside as shown in FIG. 8.

The drilling cable 364 then extends from the fastline sheave 330 to the first sheave 348 of the block 346. The cable is threaded through the first sheave 348 and then extends upward to and is threaded through the first sheave 334 of the crown 332. In a similar manner the cable then goes to the second sheave 350 of the block and returns to the second sheave 336 of the crown and continues in that fashion until the drilling cable 364 exits the sixth and final sheave 344 of the crown 332. That portion of the line 364 which exits the sixth sheave 344 of the crown then extends downwardly to and engages a tie down drum 368.

The tie down drum 368 is attached to the drilling platform 304 and includes a spiral groove (not shown) cut within its peripheral surface and extending three times around the drum 368. The drilling cable 364 is wrapped around the tie down drum 368 three times and is contained within said spiral groove of the tie down drum. The drilling cable 364 then extends from the tie down drum to a drilling cable storage spool 370.

The drilling cable storage spool 370 is a large cylindrical spool having end flanges between which the drilling cable 364 is wrapped upon the cylindrical spool. The spool 370 rotates about a spool axle 372 which is typically a length of metal pipe placed within a central bore of the spool flanges which permits the spool 370 to rotate freely about the spool axle 372. During the operation of the drilling rig 300, the drilling cable 364 is located within the drilling rig as illustrated in FIG. 8 and as just described. The purpose of the assembly just described is to provide a means for pulling lengths of drill string tubing (not shown) from the oil well located below the drilling rig. This is accomplished in the following manner.

The drill string tubing is attached to the hook portion 360 of the block 346. To pull the drill string tubing out of the well, the cable 364 is wound upon the drawworks drum 362 thereby pulling the block 346 upwards within the derrick to a position adjacent the crown 332. To lower the drill string tubing back into the well, the drilling cable 364 is reeled out from the drawworks drum 362, thereby allowing the block 346 to drop to a lower position below the crown 332. During this operation of raising and lowering the block 346, that portion of the drilling cable 364 between the sixth sheave 344 of the crown 332 and the storage spool 370 does not move. During this same lowering and raising operation, the spool 370 does not rotate. The lowering and raising operation, however, causes that portion of the drilling cable 364 which engages the crown 332 and the block 346 to be repeatedly pulled through the various pulleys and sheaves. This causes wear on the drilling cable. To provide a new wearing portion of the drilling cable 364, all that is necessary is to allow the spool 370 to rotate and to pull a portion of the cable 364 originally located between the sheave 344 and the spool 370 into engagement with the sheaves of the crown and block thereby providing a fresh portion of the cable at those locations where wear is incurred.

The drilling cable 364 may be described as a load carrying drilling cable since it carries the load or weight of the drill string tubing as it is pulled out of or lowered into the well.

The drilling rig 300 which has just been described is conventional and is not of itself an element of the present invention. The present invention relates to the string-up machine 10 previously described which is used to remove and to replace the drilling cable 364 within the drilling rig 300. The invention also includes methods by which the drilling cable 364 is removed and replaced within the drilling rig 300.

Standard Rig Methods

Referring now to FIG. 8, the drilling rig 300 is shown with the drilling cable 364 in place as it would be when the drilling rig 300 is in operation pulling drill string tubing from an oil well. A method will now be described for removing the drilling cable 364 from the drilling rig 300 with the rig in the upright position. This is the method which would be used for a standard rig and could also be used with a jackknife rig when the rig was maintained in the upright position shown in FIG. 8.

To appreciate the difficulty involved in removing the cable 364, the size and weight of the cable 364 must be taken into consideration. The cable 364 is a multi-strand woven steel wire cable typically having a diameter from $1\frac{1}{8}$ to $1\frac{5}{8}$ inches. Such cable weighs on the order of three to four pounds per foot of length. The weight of the length of cable 364 strung through the drilling rig 300 is considerable and considerable force is required to pull it through the various sheaves. Also, due to the size and weight of the cable, care must be taken in removing it from the tower so that the cable is not allowed to drop freely from the top to the bottom of the derrick and thereby possibly damage other equipment or injure workers.

Also, to fully appreciate the advantages of the methods and apparatus of the present invention, the methods previously used to remove the cable should be understood.

In removing the cable 364, the desired result is to have the cable wound upon the spool 370. This requires that some force must be applied to the spool 370 to rotate it and pull the cable 364 out of the drilling rig 300. At the same time that this is being done, the end of the cable 364 which was once attached to the drawworks drum 362 must be controlled so that it will not drop from the tower and have the grievous consequences previously mentioned.

The methods which have previously been used have been rather unsophisticated brute force methods. To supply a rotating force to the spool 370, a long length, e.g. perhaps 100 yards, of heavy rope (not shown) approximately an inch in diameter is used. This rope will be referred to as the pulling rope. The pulling rope is tied at one end to a large truck (not shown). An intermediate portion of the pulling rope closely adjacent to the end attached to the truck is then wrapped several times around the cylindrical spool portion of the spool 370 or around a similar cylindrical extension (not shown) of the spool 370. The loose end of the pulling rope is then grasped by a workman who supplies a tension force between a short portion of the loose end of the pulling rope and that portion of the pulling rope wrapped about the spool 370. The truck attached to the pulling rope then drives away from the spool 370 in a direction substantially perpendicular to the rotational axis of the spool. This causes the pulling rope to be pulled against the cylindrical spool portion of the spool 370 and to cause the spool 370 to rotate as the pulling rope is pulled away from the spool. The loose end of the pulling rope is allowed to slide through the workman's hand as he continually exerts a tensional force on that loose end so that sufficient frictional force will be generated between the pulling rope wrapped around the spool, and the spool, to rotate the spool.

Once the truck has pulled the entire length of the pulling rope across the spool 370, the rope must be moved back to the spool and the truck will once again return to a position closely adjacent the spool and the process is repeated until the spool has been rotated a sufficient number of times to wind the entire drilling cable 364 thereupon.

While this is being done, the other end of the drilling cable 364, which was originally attached to the drawworks drum 362, is controlled in a similarly crude fashion. The drilling cable 364 is disconnected from the drawworks 362 and is attached to one end of a restraining line (not shown). A second workman wraps the restraining line several times around a suitable fixed cylindrical post (not shown) and then exerts a tensional force on the loose end of the restraining line so that the frictional force developed between the restraining line and the post can be used to ensure that the cable 364 can be lowered through the various sheaves in a controlled manner.

The procedure which has just been described is considerably improved upon by the use of the string-up machine 10.

To remove the drilling cable 364 from the drilling rig 300 by the use of the string-up machine 10, the string-up machine 10 is moved into a location similar to that illustrated in FIG. 9 so that one of the friction drive collars 104, 106, 108 and 110 engages each of the flanges of the drilling cable storage spool 370. The following description refers to FIG. 8 with the derrick in the upright position.

The first winch spool 74 of the string-up machine 10 has wrapped thereupon a long length of guide cable 374. The guide cable 374 is preferably a 5/16 inch diameter woven steel wire cable. An end of the guide cable 374 is threaded through idler pulley 376 which is rotatingly attached to the drilling platform 304 closely adjacent the drawworks drum 362. The drilling cable 364 is reeled out from the drawworks drum 362 until the block 346 is lowered to a position where it rests upon the drilling platform 304. The drilling cable 364 is then disconnected from the drawworks drum 362, and the guide cable 374 is attached to that end of the drilling cable 364 previously connected to the drawworks drum 362. The guide cable 374 is attached to the drilling cable 364 by means of a splicing adaptor (not shown) which permits the point of junction between the cables to pass through the various sheaves and pulleys without hanging up.

The dog 76 of the string-up machine 10 is moved into a disengaged position so that the first winch spool 74 is allowed to freely rotate about the first winch shaft 72.

To controllably permit the guide cable 374 to be reeled out from the first winch spool 74, the disc brake assembly 133 is used to restrain the rotation of the spool 74.

The drilling cable 364 is removed from the drilling rig 300 by rotating the friction drive collars 104, 106, 108 and 110 with the second hydraulic motor 118. The friction collars which engage the flanges of the drilling cable storage spool 370 cause the storage spool 370 to be forceably rotated about the spool axle 372 thereby pulling the drilling cable 364 from the drilling rig 300 and winding it upon the storage spool 370. As the drilling cable 364 is pulled through the various sheaves of the drilling rig 300, its loose end is controlled by the guide cable 374 which is controllably allowed to be reeled out from the first winch spool 74 by means of the disc brake assembly 133. Once the entire drilling cable 364 has been wound upon the spool 370, the guide cable 374 is then in a position similar to that that the drilling cable 364 was originally in. That is, the guide cable 374 is now in place throughout the various sheaves of the drilling rig 300.

To retrieve the guide cable 374, the dog 76 is engaged and the first winch spool 74 is rotated by means of the first hydraulic motor 86. When retrieving the guide cable 374, it is necessary that the loose end of the guide cable also be controlled. This is due not to the weight of the guide cable, as was the case when removing the drilling cable, but due to the fact that the guide cable tends to assume a helical shape if a tensional force is not retained upon the guide cable. The steel guide cable 374 tends to assume this helical shape when it has been kept wound about the first winch spool 74 for a long period of time. If the guide cable is allowed to go free, it will ball up and hang up within the drilling rig 300 and cannot be pulled therefrom. A small retaining rope or line is therefore attached to the lower end of the guide cable 374 and is used to retain a tensional force upon the guide cable 374 as it is pulled from the drilling rig 300. The guide cable 374 is pulled from the drilling rig 300 in a reverse or backwards direction from that direction in which it was pulled into the drilling rig. The flexible rope 112 mounted upon the second winch spool 98 may be used as a retaining line for this purpose. Once the guide cable 374 has been retrieved, the retaining line may then be pulled from the drilling rig 300 without any concern for controlling its loose end, as due to the light weight and flexible nature of the retaining line no harm will be done by allowing it to fall freely through the drilling rig 300.

To further understand the manner in which flexible rope 112 is used as a retaining line, the position of the guide cable 374 immediately after the drilling cable 364 is removed must be visualized. The guide cable 374 will be in the same position within the sheaves of crown 332 and block 346 as is illustrated in FIG. 8 for drilling cable 364. The end of guide cable 374 extending from sixth sheave 344 of crown 332 will be attached to the drilling cable 364 which will be essentially completely wound upon spool 370. The end of guide cable 374 extending from fastline sheave 330 will be connected to first winch means 74.

The end of guide cable 374 which is attached to drilling cable 364 is then disconnected therefrom and connected to flexible rope 112. The connection between flexible rope 112 and guide cable 374 is made by merely tying a knot between the two. This knot has no trouble passing through the various sheaves since the rope 112 and guide cable 374 are of much smaller diameter than is drilling cable 364. The guide cable 374 is then wound upon first winch means 74, and simultaneously a tensional force is maintained on flexible rope 112. The tensional force may be maintained either manually or by the use of a braking means on second winch means 98 upon which flexible rope 112 is wound.

The procedure will now be described for installing the drilling cable 364 in a standard upright drilling rig. This description begins with the situation where the spool 370 has contained thereon the entire length of the drilling cable 364 and the block 346 is laying upon the drilling platform 304. There is no cable or line of any kind in place within any of the sheaves of the drilling rig or upon the drawworks drum 362.

The general method by which the drilling cable 364 is installed includes a first step of threading the guide cable 374 from the first winch spool 74 of the string-up machine 10 through the idler pulley 376 and then threading it through the fastline sheave 330 and the various sheaves of the block and crown, then about the tie down drum 368 and finally to the drilling cable storage spool 370 where it is attached to the loose end of the drilling cable 364. The second step is comprised of pulling the guide cable 374 back through the various sheaves and pulling behind it the drilling cable 364. The power for pulling the cables is provided through the winch spool 74 by means of the first hydraulic motor 86.

More particularly, with reference to FIGS. 10, 11, 12, 13, 14 and 15, the guide cable 374 is threaded through the various pulleys and sheaves of the drilling rig 300, when it is in an upright position, in the following manner.

FIGS. 10 through 15 show a schematic representation of certain of the pulleys and sheaves of the drilling rig 300. Depicted in those figures are the idler pulley 376, the fastline sheave 330, the first and second sheaves 334 and 336 of the crown 332, and the first and second sheaves 348 and 350 of the block 346. It should be remembered that when the guide cable is being placed within the various pulleys and sheaves, the block 346 is laying upon the drilling platform 304.

Figure 10:
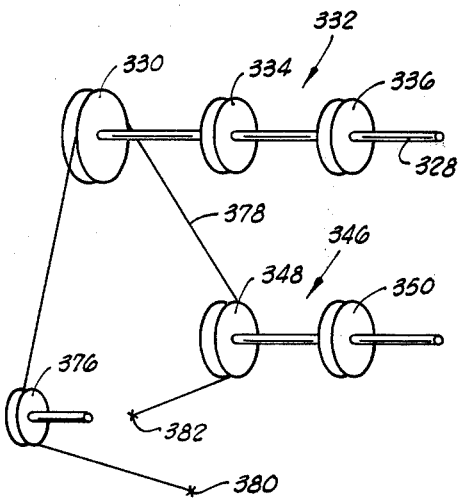
FIGS. 10–15 show certain sheaves and pulleys of the drilling rig of FIG. 8 in a schematic manner depicting the various steps of stringing-up a guide cable within the drilling rig by the use of a guide rope attached to the guide cable.

Referring specifically to FIG. 10, a length of guide rope 378 is carried manually up to the top of the derrick 302 to a position adjacent the fastline sheave 330. The guide rope 378 is preferably a 5/16 inch diameter rope. An intermediate portion of the guide rope 378 is then placed about the fastline sheave 330 and the two free ends of the guide rope 378 are lowered to the drilling platform 304 where a first end 380 of the guide rope 378 is placed about the idler pulley 376, and a second end 382 of the guide rope 378 is threaded through the first sheave 348 of the block 346.

Figure 11:
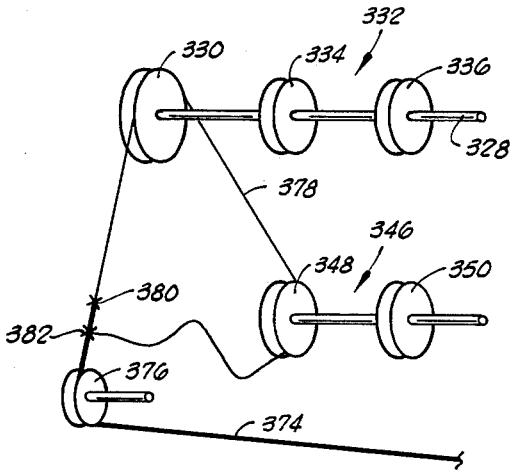

Referring now to FIG. 11, the next step is illustrated as follows. The first end 380 of the guide rope 378 has been attached to the end of the guide cable 374 extending from the first winch spool 74 (not shown). The guide rope 378 and guide cable 374 have been pulled through the pulley 376 so that the first end 380 is located above the pulley 376 as shown. Then the second end 382 of the guide rope 378 has been tied to the guide cable 374 just behind the connection of the guide cable 374 and the guide rope 378 at the first end 380.

Figure 12:
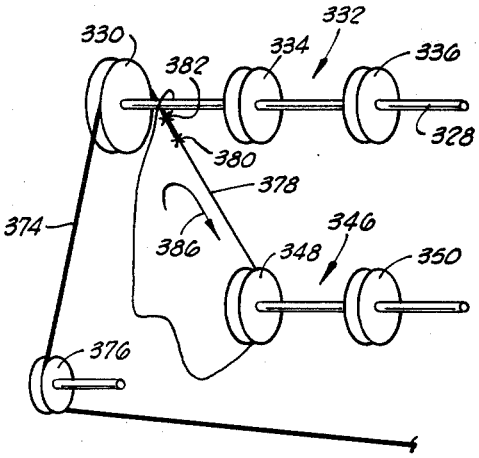

Referring now to FIG. 12, the next step is illustrated as follows. The guide rope 378 has been partially pulled through the first sheave 348 of the block 346 thereby pulling the guide cable 374 up over the fastline sheave 330.

A preferred method for exerting the necessary force on the guide rope 378 to pull it and the attached guide cable 374 through the various sheaves is to wrap a portion of the guide rope 378 about a cathead on a rotating part and to thereby impart the necessary force to the guide rope 378. A cathead is a cylindrical apparatus such as the first and second catheads 82 and 114 shown in FIG. 1 mounted upon the rotating shafts of the string-up machine 10. A similar cathead 384 is generally mounted upon the drawworks drum 362. By wrapping a portion of the guide rope 378 about the cathead 384 and applying an appropriate tensional force to the guide rope, the frictional forces between the guide rope and the cathead will transmit a much greater tensional force to the guide rope thereby causing it to be pulled through the sheave 348 and causing the guide rope to move in the direction generally indicated by the curved arrow 386.

Figure 13:
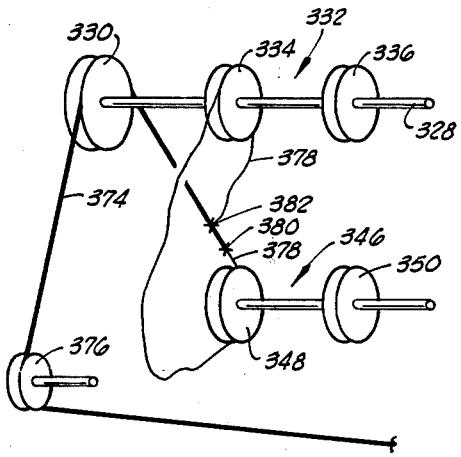

Referring to FIG. 13, the next step of the string-up procedure is illustrated as follows. As the cathead 384 is used to continually pull the guide rope 378 through the sheave 348, the second end 382 of the guide rope 378 moves past a point closely adjacent the first sheave 334 of the crown 332. A workman stationed adjacent the crown then picks up that portion of the guide rope 378 adjacent to the second end 382 and places the guide rope over the first sheave 334 of the crown 332.

Figure 14:
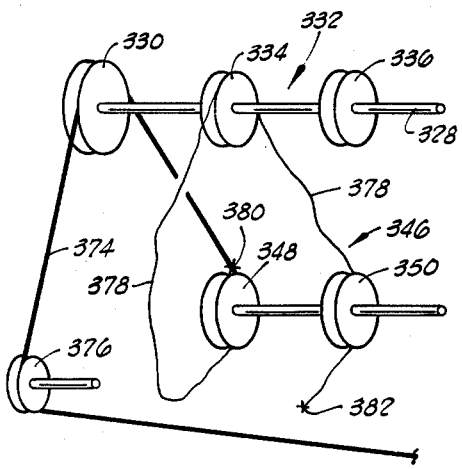

Referring now to FIG. 14, the next step is illustrated as follows. The guide rope 378 has been continually pulled through the sheave 348 of the block 346 until the first end 380 has reached a point closely adjacent the sheave 348. At that time, the second end 382 of the guide rope 378 was removed from the guide cable 374 and threaded through the second sheave 350 of the block 346, as shown.

Figure 15:
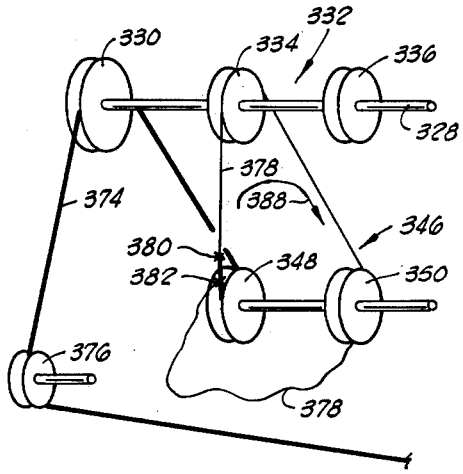

Referring now to FIG. 15, the next step is illustrated as follows. The guide rope 378 has been pulled through the sheave 348 until the first end 380 of the guide rope 378 has passed completely through the sheave 348. The second end 382 of the guide rope 378 has once again been tied to the guide cable 374 closely adjacent the first end 380. Next, that portion of the guide rope 378 which has already passed through the second sheave 350 of the block 346 is placed in engagement with the cathead 384 of the drawworks drum 362 and the guide rope 378 is pulled through the second sheave 350 in a similar manner as it was pulled through the first sheave 348 of the block 346. The guide rope 378 is now pulled through the sheaves in the direction generally indicated by the curved arrow 388.

From this point on, the process is a repetition of the steps just described and the guide rope 378 is consecutively threaded through the sheave 336, thence through the sheaves 352, 338, 354, 340, 356, 342, 358 and thence through the sixth and final sheave 344 of the crown 332.

Then the second end 382 of the guide rope 378 is untied from the guide cable 374 and is lowered to a position adjacent the ground surface 390. The guide rope 378 and the guide cable 374 are then pulled further through the various sheaves about which they have been placed until a sufficient length of the guide cable 374 has been passed through the final sheave 344 of the crown 332. A portion of the guide cable 374 is then wrapped around the triple spiral groove of the tie down drum 368 and the end of the guide cable 374 is moved to a position closely adjacent the drilling cable spool 370. The first end 380 of the guide rope 378 is then also untied from the guide cable 374.

Then, the loose end of the guide cable 374 is attached to an end of the drilling cable 364 extending from the spool 370, by means of a splicing adaptor (not shown) as previously described.

The guide cable 374 is then retrieved through the various sheaves and pulleys of the drilling rig 300 by winding the guide cable 374 up on the first winch spool 74 of the string-up machine 10 thereby pulling the drilling cable 364 behind the guide cable 374 into place within the various sheaves and pulleys. When the end of the drilling cable 364 connected to the guide cable 374 reaches a point adjacent the drawworks drum 362, the drilling cable 364 is disconnected from the guide cable 374 and the drilling cable 364 is then attached to the drawworks drum 362. The drilling cable 364 is now once again in place within the drilling rig 300 in the manner illustrated in FIG. 8.

The method just described above can be summarized in a broad general form as being a method of stringing-up a drilling cable or other flexible line within a drilling rig or sheave system by first stringing-up a guide cable or other flexible line.

In its simplest form, a drilling rig having an upper sheave system and lower sheave system could be comprised of a rig having only one sheave in the crown 332 and one sheave in the block 346. With reference to such a system, the method of stringing-up would be described as follows.

First, an intermediate portion of the guide rope 378 is placed about or in engagement with a first upper sheave, namely the fastline sheave 330. Then the first end 380 of the guide rope 378 is connected to an end of the guide cable 374.

An intermediate portion of the guide rope 378 is then placed about a second lower sheave, namely the first sheave 348 of the block 346. Then the second end 382 of the guide rope 378 is connected to the guide cable 374.

Then the guide rope 378 is pulled through said second lower sheave 348 until that position illustrated in FIG. 12 is reached at which time an intermediate portion of the guide rope 378 is placed about a third upper sheave, namely the first sheave 334 of the crown 332 as seen in FIG. 13.

Assuming for the purposes of this general description that the crown includes only the one sheave, the second end 382 of the guide rope 378 is then disconnected from the guide cable 374 and the guide rope 378 is pulled through said third upper sheave, namely the first sheave 334 of the crown 332. Then the first end 380 of the guide rope 378 is also disconnected from the guide cable 374 and the guide cable 374 is then connected to the drilling cable 364. The guide cable 374 is then pulled backwards through the various sheaves so that the drilling cable 364 is pulled into place within the drilling rig.

The Jackknife Rig

The method by which the drilling cable 364 is installed and removed within a jackknife rig will now be described.

Referring to FIG. 8, the jackknife rig is shown in the upright position with the drilling cable 364 in place within the various sheaves and pulleys and attached at its ends to the drawworks drum 362 and the cable storage spool 370.

To remove the drilling cable 364, the upper portion 308 of the derrick 302 is pivoted about the pivot point 324 and lowered to a horizontal position, as shown in FIG. 9.

The upper end of the pivoted portion 308 is supported by support member 392 so that the side member 318 is lying in the horizontal plane of the upper surface of the drilling platform 304.

To move the pivoted member 308 to this position, a rope is attached to the pivoted member 308 at a point adjacent the platform 326 and a force is exerted on the rope by a truck (not shown) or other vehicle attached to the other end of the rope thereby pulling the tower so as to pivot it in a clockwise fashion as viewed in FIG. 8 about the point 324.

As the pivoted portion 308 begins to move, the drilling cable 364 engages the roller 366 and the drilling line 364 is then controllably released from the drawworks drum 362 so as to lower the pivoted portion 308 of the derrick 302 to the position shown in FIG. 9.

The block 346 is then placed upon an extension 394 of the drilling platform 304. The extension 394 is sometimes referred to as the catwalk 394. When the block is placed upon the catwalk, the various portions of the drilling cable 364 running from the block to the fastline sheave and the crown sheaves lie across a support pipe 396 which is attached to the platform extension 326 of the pivoted portion 308. That portion of the drilling line 364 between the sixth sheave 344 of the crown 332 and the tie down drum 368 engages a second support pipe extension 398 which is attached to the drilling platform 304.

To remove the drilling cable 364 from the drilling rig 300, the string-up machine 10 is moved into the position shown in FIG. 9 such that one of the drilling collars 104, 106, 108 and 110 engages each of the flanges of the spool 370. The drilling collars are then rotated by means of the second hydraulic motor 118 so as to cause the drilling cable storage spool 370 to rotate about the spool axle 372 and to wind the drilling cable 364 upon the storage spool 370.

Since the derrick has been moved to the pivoted position of FIG. 9, it is not necessary to control the loose end of the drilling cable 364 which is detached from the drawworks drum 362. The drilling cable 364 may be merely wound upon the spool 370.

The method for replacing the drilling cable 364 within a jackknife drilling rig will now be described. The drilling cable 364 is replaced with the jackknife rig in the pivoted position as shown in FIG. 9. The manner of replacing the drilling cable 364 within the jackknife rig is very similar to the manner previously described for the standard rig, or for the jackknife rig when in an upright position as shown in FIG. 8.

The guide rope 378 (not shown) is attached at its first end 380 to the guide cable 374 from the first winch spool 74. The second end 382 of the guide rope 378 is then threaded through the idler pulley 376 and extended over the pulley 366 located at the apex of the A-frame 306 and is then extended to the fastline pulley 330 and then brought back down to the first sheave 348 of the block 346. The second end 382 of the guide rope 378 is then tied to the guide cable 374 closely adjacent the connection to the first end 380.

The guide rope 378 and guide cable 374 are then pulled through the first sheave 348 of the block 346 in the manner previously described with relation to FIGS. 10 through 15, and then consecutively through the various sheaves of the crown 332 and the block 346 until the second end 382 is threaded through the sixth sheave 344 of the crown 332. The power for pulling the guide rope 378 is preferably provided by the use of one of the catheads 82 or 114 of the string-up machine 10. The guide rope 378 is then passed over the second support pipe extension 398 and around the tie down drum 368.

The guide rope 378 is then extended towards the drilling cable spool 370 until the first end 380 of the guide rope 378 attached to the guide cable 374 reaches a point adjacent the spool 370. Then the guide rope 378 is disconnected form the guide cable 374 and the guide cable 374 is connected to the drilling cable 364 extending from the spool 370. This connection between the guide cable and the drilling cable is made by means of a splicing adaptor (not shown) as previously described.

To pull the drilling cable 364 into place, the guide cable 374 is wound upon the first winch spool 74 which is driven by the first hydraulic motor 86. As the guide cable 374 is retrieved through the various sheaves and pulleys, it pulls behind it the drilling cable 364 and thereby threads it through the various sheaves and pulleys until the connection between the guide cable 374 and the drilling cable 364 reaches a point adjacent the drawworks drum 362. The guide cable 374 is then disconnected from the drilling cable 364, and the drilling cable 364 is connected to the drawworks drum 362. The drilling cable 364 is now once again in the position shown in FIG. 9.

The pivoted portion 308 of the drilling rig 300 is then pivoted back to the upright position of FIG. 8 by means of the drawworks drum 362 pulling upon the drilling cable 364.

As mentioned above, FIGS. 8 and 9 show the drilling cable and the various sheaves and pulleys in a somewhat schematic form, in that the details of construction of the sheaves and the derrick are not shown. Also, the locations of the various sheaves and pulleys relative to each other and to the derrick are shown in a schematic form. It will be understood by those skilled in the art that the methods described above, and particularly the detailed description with reference to FIGS. 10 through 15, may require some minor modification for application to any specific drilling rig structure to permit junctions between the cables to pass around the sheaves and through the derrick structure.

For example, on drilling rigs having an outer housing about an upper portion of the fastline sheave 330, it will be necessary to disconnect the second end 382 from the guide cable 374 before the second end 382 passes by the fastline sheave. In FIG. 12, it was assumed that the fastline sheave 330 was of the open type and that it was possible for the second end 382 to engage the fastline sheave 330 and pass over it while still connected to the guide cable 374.

Thus, the apparatus and methods for stringing-up and removing drilling cables, of the present invention are well adapted to carry out the objects and attain the ends and advantages mentioned, as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. Apparatus for removing a load carrying drilling cable from a drilling rig, comprising:
   - a drilling cable storage spool means for receiving and storing said load carrying drilling cable, said spool means being mounted to rotate in place above a ground surface;
   - friction drive means for engaging said storage spool means to rotate said spool means in place and reel said drilling cable thereon; and
   - vehicle means, upon which said friction drive means is mounted, for moving said friction drive means into engagement with said storage spool means by moving said vehicle means across said ground surface.

2. The apparatus of claim 1, further comprising:
   - power drive means, mounted upon said vehicle, for rotating said friction drive, means; and
   - power transmission means, connecting said power drive means and said friction drive means, so that said drilling cable storage spool is rotated to reel said drilling cable onto said storage spool.

3. The apparatus of claim 1, wherein:
   - said vehicle means includes a frame having a sloped extension; and
   - said friction drive means is rotatably mounted upon said sloped extension, so that when said friction drive means engages said storage spool below a horizontal centerline of the storage spool, the force exerted upon the friction drive means will urge the friction drive means toward said sloped extension.

4. The apparatus of claim 1, wherein said friction drive means further comprises:
   - a rotating shaft; and
   - a friction drive collar mounted upon said shaft.

5. The apparatus of claim 4, wherein said friction drive means further comprises:
   - a second friction drive collar, spaced from said first drive collar, so that each of said drive collars may engage a flange of said drilling cable storage spool to provide a rotating driving force to said flanges.

6. Apparatus for removing and replacing a load carrying drilling cable within a drilling rig, comprising:
   - a drilling cable storage spool means for receiving and storing said load carrying drilling cable, said spool means being mounted to rotate in place above a ground surface;
   - friction drive means for engaging said storage spool means to rotate said spool means in place and reel said drilling cable thereon;
   - vehicle means, upon which said friction drive means is mounted, for moving said friction drive means into engagement with said storage spool means by moving said vehicle across said ground surface; and
   - winch means, mounted upon said vehicle means, including a guide cable for guiding said load carrying drilling cable.

7. The apparatus of claim 6 wherein said winch means further comprises:
   - a winch shaft;
   - means for rotating said winch shaft;
   - a winch spool mounted upon said winch shaft; and
   - means for selectively connecting and disconnecting said winch spool from said winch shaft so that when said winch spool is connected to said winch shaft the spool rotates with the shaft and when said spool is disconnected from said shaft the spool rotates freely about the shaft.

8. The apparatus of claim 7 wherein said means for selectively connecting and disconnecting comprises:
   - a dog, having a fixed portion attached to said winch spool, and a sliding portion slidingly engaging said winch shaft, each of said fixed and sliding portions having a plurality of complementary teeth, so that the winch shaft is connected to the winch spool by moving the sliding dog portion into engagement with the fixed dog portion.

9. Apparatus of claim 6, further comprising brake means, engaging said winch means, for controllably releasing said guide cable from said winch means.

10. The apparatus of claim 9, wherein said brake means comprises:
   - a flange attached to said winch means; and
   - disc brake means engaging said flanges, so that the rotation of said winch means may be retarded by clamping said flange with said disc brake means.

11. A string-up machine, comprising:
   - a frame;

first winch means, rotatably mounted upon said frame, for receiving a guide cable;

second winch means, rotatably mounted upon said frame;

a friction drive collar, mounted upon said second winch means, for engagement with a drilling cable storage spool of a drilling rig, the combination of said second winch means and said friction drive collar being so constructed that said combination may alternately serve as either a winch or a means for rotating said storage spool to wind a load carrying drilling cable of said drilling rig thereon; and brake means, engaging said first winch means, for retarding the rotation of said first winch means.

12. The string-up machine of claim 11, wherein said first winch means comprises:

a first winch shaft, rotatably mounted upon said frame;

a first winch spool, mounted upon said first winch shaft;

dog means, for selectively connecting and disconnecting said winch spool from said winch shaft; and means for rotating said first winch shaft.

13. The string-up machine of claim 12, wherein said second winch means comprises:

a second winch shaft, rotatably mounted upon said frame;

a second winch spool, attached to said second winch shaft; and means for rotating said second winch shaft.

14. The string-up machine of claim 13 wherein:

said means for rotating said first winch shaft includes a first hydraulic motor connected to said first winch shaft by first power transmission means;

said means for rotating said second winch shaft includes a second hydraulic motor connected to said second winch shaft by second power transmission means, and said string-up machine further comprises;

a first four-way control valve connected to said first hydraulic motor for control thereof; and a second four-way control valve connected to said second hydraulic motor for control thereof.

15. The string-up machine of claim 14 further comprising:

an oil sump having baffle means with a closed end and an open end, said baffle means dividing said oil sump into first and second chambers, said first and second chambers being in fluid communication through said open end of said baffle means;

a hydraulic pump;

a pump suction line connecting said hydraulic pump to said second chamber of said oil sump at a location adjacent the closed end of said baffle;

a pump discharge line connecting said hydraulic pump with an inlet of said first four-way valve;

first fluid inlet and outlet lines connecting said first four-way valve to said first hydraulic motor;

an intermediate hydraulic line connecting an outlet of said first four-way valve with an inlet of said second four-way valve;

second inlet and outlet lines connecting said second four-way valve with said second hydraulic motor;

a return line connecting an outlet of said second four-way valve with said first chamber of said oil sump at a location adjacent the closed end of said baffle.

16. The string-up machine of claim 11 wherein:

said second winch means comprises a winch shaft rotatably mounted upon said frame, a winch spool attached to said winch shaft, and means for rotating said winch shaft; and said string-up machine further comprises a second friction drive collar mounted upon said winch spool and spaced from said first friction drive collar, so that each of said drive collars may engage a flange of said drilling cable storage spool.

17. The string-up machine of claim 16 wherein:

said frame comprises a pair of longitudinal frame members having sloped extensions upon which the winch shaft is mounted.

18. The string-up machine of claim 11 wherein said brake means comprises:

a flange attached to said first winch means; and disc brake means for engaging said flange of said first winch means to retard the rotation of said first winch means.

19. A method of removing a load carrying drilling cable from a drilling rig comprising:

moving a rotatable friction drive means into direct engagement with a rotatable drilling cable storage spool attached to a first end of said drilling cable said movement of said drive means being in a direction transverse to an axis of rotation of said storage spool; and rotating said friction drive means so that said storage spool is rotatably driven in place by direct frictional engagement with said friction drive means and said drilling cable is pulled from said drilling rig and wound upon said storage spool.

20. The method of claim 19, further comprising:

connecting a guide cable to a second end of said drilling cable; and applying a retarding force to said guide cable as the drilling cable is pulled from the drilling rig, so that said second end of said drilling cable is prevented from falling freely from said drilling rig.

21. The method of claim 20, wherein said guide cable is contained upon a winch spool having a flange and being mounted upon a winch shaft, said winch spool being connected to said winch shaft by a means for selectively connecting and disconnecting said winch spool from said winch shaft, further comprising:

moving said means for selectively connecting said disconnecting to a disconnected position so that said winch spool may freely rotate about said winch shaft; and applying a retarding force to said flange of said winch spool, to controllably release said guide cable from said winch spool as said drilling cable is wound upon said drilling cable storage spool.

22. The method of claim 20, further comprising:

disconnecting said guide cable from said drilling cable, after said drilling cable is wound upon said storage spool;

connecting the end of said guide cable, which was attached to said drilling cable, to a retaining line;

pulling said guide cable from said drilling rig in the reverse direction from that in which it was pulled into the drilling rig; and applying a tensional force to said retaining line as said guide cable is pulled from said drilling rig.

23. A method of stringing-up a first flexible line within a sheave system, comprising:

placing a second flexible line about a first sheave;

connecting a first end of said second flexible line to an end of said first flexible line;

placing said second flexible line about a second sheave;

connecting a second end of said second flexible line to said first flexible line;

pulling said second line through said second sheave; and placing said second flexible line about a third sheave.

24. The method of claim 23, further comprising:

placing said second line about a fourth sheave; and pulling said second line through said fourth sheave.

25. A method of stringing-up a third flexible line within a sheave system, said method including the method of claim 23, and further comprising:

disconnecting said second end of said second flexible line from said first flexible line;

pulling said second flexible line through said third sheave;

disconnecting said first end of said second flexible line from said first flexible line;

connecting said first flexible line to said third flexible line; and pulling said first flexible line backwards through said sheaves, so that said third flexible line is pulled into place within said sheave system.

26. A method of stringing-up a guide cable within a drilling rig having a set of upper sheaves and a set of lower sheaves, comprising:

placing an intermediate portion of a guide rope in engagement with a first upper sheave;

connecting a first end of said guide rope to an end of said guide cable;

placing an intermediate portion of said guide rope in engagement with a second lower sheave;

connecting a second end of said guide rope to said guide cable;

pulling said guide rope through said second lower sheave; and placing an intermediate portion of said guide rope in engagement with a third upper sheave.

27. The method of claim 26, further comprising:

placing said guide rope in engagement with a fourth lower sheave; and pulling said guide rope through said fourth lower sheave.

28. A method of stringing-up a drilling cable within a drilling rig, said method including the method of claim 26, and further comprising:

disconnecting said second end of said guide rope from said guide cable;

pulling said guide rope through said third upper sheave;

disconnecting said first end of said guide rope from said guide cable;

connecting said guide cable to said drilling cable; and pulling said guide cable backwards through said sheaves, so that said drilling cable is pulled into place within said drilling rig.

29. A method of removing a drilling cable from a drilling rig, comprising:

moving a rotatable friction drive means into engagement with a rotatable drilling cable storage spool attached to a first end of said drilling cable;

rotating said friction drive means so that said storage spool is rotatably driven by said friction drive means and said drilling cable is pulled from said drilling rig and wound upon said storage spool;

connecting a guide cable to a second end of said drilling cable, said guide cable being contained upon a winch means including a winch spool connected to a winch driving means by a means for selectively connecting and disconnecting said winch spool from said winch drive means;

moving said means for selectively connecting and disconnecting to a disconnected position so that said winch spool may freely rotate; and applying a retarding force to said winch spool to controllably release said guide cable from said winch spool, as said drilling cable is wound upon said drilling cable storage spool and pulled from said drilling rig, so that said second end of said drilling cable is prevented from falling freely from said drilling rig.

30. A method of removing a load carrying drilling cable from a drilling rig of the type having a drilling cable storage spool means attached to a first end of said drilling cable for receiving and storing said drilling cable, said spool means being mounted to rotate in place above a ground surface, said method comprising the steps of:

moving a vehicle means, having a friction drive means mounted thereon, across said ground surface to engage said friction drive means with said drilling cable storage spool means; and rotating said friction drive means so that said spool means is rotatably driven in place by said friction drive means and said drilling cable is pulled from said drilling rig and wound upon said storage spool.

31. The method of claim 30, further comprising:

connecting a guide cable to a second end of said drilling cable; and applying a retarding force to said guide cable as the drilling cable is pulled from the drilling rig, so that said second end of said drilling cable is prevented from falling freely from said drilling rig.

32. The method of claim 31, wherein said guide cable is contained upon a winch means including a winch spool connected to a winch driving means by a means for selectively connecting and disconnecting said winch spool from said winch driving means, further comprising the steps of:

moving said means for selectively connecting and disconnecting to a disconnected position so that said winch means may freely rotate; and applying a retarding force to said winch means, to controllably release said guide cable therefrom as said drilling cable is wound upon said drilling cable storage spool.

33. The method of claim 31, further comprising:

disconnecting said guide cable from said drilling cable, after said drilling cable is wound upon said storage spool;

connecting the end of said guide cable, which was attached to said drilling cable, to a retaining line;

pulling said guide cable from said drilling rig in the reverse direction from that in which it was pulled into the drilling rig; and applying a tensional force to said retaining line as said guide cable is pulled from said drilling rig.

34. A method of stringing-up a flexible line means within a sheave system, comprising:

placing said flexible line means about a first sheave;

placing said flexible line means about a second sheave;

connecting an end of said flexible line means to an intermediate portion of said flexible line means to form a loop;

pulling a portion of said loop through said second sheave; and placing said flexible line means about a third sheave.

35. The method of claim 34, further comprising:

placing said flexible line means about a fourth sheave; and pulling a portion of said loop through said fourth sheave.

36. A method of stringing-up a second flexible line means within a sheave system, said method including the method of claim 34, and further comprising:

disconnecting said end of said first flexible line means from said intermediate portion of said first flexible line means;

connecting said first flexible line means to said second flexible line means, and pulling said first flexible line means backwards through said sheaves, so that said second flexible line means is pulled into place within said sheave system.

37. A method of stringing-up a flexible guide line means within a drilling rig having a set of upper sheaves and a set of lower sheaves, comprising:

placing said flexible guide line means in engagement with a first upper sheave and a second lower sheave;

connecting an end of said flexible guide line means to an intermediate portion of said flexible guide line means to form a loop;

pulling a portion of said loop through said second lower sheave; and placing said flexible guide line means in engagement with a third upper sheave.

38. The method of claim 37, further comprising:

placing said flexible guide line means in engagement with a fourth lower sheave; and pulling a portion of said loop through said fourth lower sheave.

39. A method of stringing-up a drilling cable within a drilling rig, said method including the method of claim 37, and further comprising:

disconnecting said end of said flexible guide line means from said intermediate portion of said flexible guide line means;

connecting said flexible guide line means to said drilling cable; and pulling said flexible guide line means backwards through said sheaves, so that said drilling cable is pulled into place within said drilling rig.

* * * * *